US008340341B2

(12) United States Patent
Perkins et al.

(10) Patent No.: US 8,340,341 B2
(45) Date of Patent: Dec. 25, 2012

(54) COATED SPEAKER DOME

(75) Inventors: Neil Perkins, Reading (GB); Charles Simon James Pickles, Kingston (GB); Christopher John Howard Wort, Wantage (GB); Geoffrey Alan Scarsbrook, Ascot (GB)

(73) Assignee: Element Six Limited, Ballasalla (GB)

( * ) Notice: Subject to any disclaimer, the term of this patent is extended or adjusted under 35 U.S.C. 154(b) by 1143 days.

(21) Appl. No.: 11/813,959

(22) PCT Filed: Jan. 12, 2006

(86) PCT No.: PCT/IB2006/000049

§ 371 (c)(1),
(2), (4) Date: Oct. 9, 2007

(87) PCT Pub. No.: WO2006/075238

PCT Pub. Date: Jul. 20, 2006

(65) Prior Publication Data

US 2008/0130937 A1 Jun. 5, 2008

(30) Foreign Application Priority Data

Jan. 14, 2005 (GB) ..... 0500788.5

(51) Int. Cl.

| | |
|---|---|
| ***H04R 1/00*** | (2006.01) |
| ***H04R 1/02*** | (2006.01) |
| ***H04R 7/00*** | (2006.01) |
| ***B21C 37/00*** | (2006.01) |

(52) U.S. Cl. ..... 381/426; 181/168; 181/169; 181/170; 381/386; 381/423; 428/606

(58) Field of Classification Search ..... 381/426, 381/386, 423; 181/168, 169, 170; 428/606
See application file for complete search history.

(56) References Cited

U.S. PATENT DOCUMENTS

| | | | | |
|---|---|---|---|---|
| 3,328,537 | A * | 6/1967 | Hecht | 381/426 |
| 4,470,479 | A * | 9/1984 | Inoue et al. | 181/168 |
| 4,772,513 | A * | 9/1988 | Sakamoto et al. | 428/408 |
| 4,987,002 | A * | 1/1991 | Sakamoto et al. | 427/450 |
| 5,241,140 | A * | 8/1993 | Itoh et al. | 181/169 |
| 5,403,399 | A * | 4/1995 | Kurihara et al. | 118/723 DC |
| 5,556,464 | A * | 9/1996 | Tanabe et al. | 117/106 |
| 5,744,761 | A * | 4/1998 | Ogura et al. | 181/167 |
| 6,777,074 | B2 * | 8/2004 | Noda | 428/325 |
| 2004/0235405 | A1 * | 11/2004 | Sung | 451/443 |
| 2007/0195986 | A1 * | 8/2007 | Geaves | 381/430 |
| 2008/0124566 | A1 * | 5/2008 | Smallman et al. | 428/606 |

FOREIGN PATENT DOCUMENTS

| | | | |
|---|---|---|---|
| CN | 2150611 | Y | 12/1993 |
| GB | 2236541 | A * | 4/1991 |
| JP | 55 068796 | | 5/1980 |
| JP | 58 120394 | | 7/1983 |
| JP | 61-161897 | A | 7/1986 |
| JP | 4-150197 | A | 5/1992 |

OTHER PUBLICATIONS

Specification for U.S. Appl. No. 60/636,110, of U.S. Appl. No. 11/720,360, US publication 2008/0124566.*

English Translation of Official Action issued Apr. 19, 2011 in Japanese Patent Application No. 2007-550867.

Office Action issued Jul. 26, 2012 in Chinese Patent Application No. 200680002285.6, with English translation.

* cited by examiner

*Primary Examiner* — David Warren
*Assistant Examiner* — Christina Russell
(74) *Attorney, Agent, or Firm* — Oblon, Spivak, McClelland, Maier & Neustadt, L.L.P.

(57) ABSTRACT

A rigid three-dimensional component such as a speaker dome is formed of diamond, preferably fabricated to net shape by CVD diamond synthesis, and includes a coating on one or more major surfaces thereof. The coating is designed to enhance the performance and/or to alter the appearance of the component. In particular, the coating is designed to act as a damping medium and/or provide aesthetic qualities to the component.

32 Claims, No Drawings

COATED SPEAKER DOME

BACKGROUND OF THE INVENTION

THIS invention relates to rigid three-dimensional components, which have high rigidity and low mass, and in particular to coated speaker domes.

There are many applications requiring structures of high rigidity and low mass. Typical applications are in the aerospace industry where virtually all mechanical components must have a high rigidity to mass ratio.

However, there is a range of other applications for light but rigid bodies. A particular application is the production of drive units for acoustic loudspeakers, and in particular high frequency tweeters for the accurate reproduction of high frequency sounds.

Human hearing is commonly accepted to cover the range 20 Hz-20 kHz. Therefore a high quality loudspeaker system needs to accurately reproduce frequencies at least over this frequency range. Typical high performance loudspeakers employ two or more drive units that are effectively mechanical transducers converting an electrical signal into a sound (compression) wave. Each drive unit will cover a specific part of the audible range. The drive unit can be approximated to a piston moving backwards and forwards to create compression and rarefaction of air.

It is well known that small pistons can efficiently generate high sound pressure levels at high frequencies while larger diameter pistons are required to produce comparable sound pressure levels at lower frequencies with comparable efficiency. Typically a 25 mm diameter drive unit can operate in the frequency range 2-20 kHz while a larger drive unit of, say, 100-250 mm diameter can produce frequencies in the range down to 100 Hz and below. However, larger drive units cannot easily be used to produce high frequency sounds due to the problems of unwanted oscillations or break-up that can occur. Human ears are very sensitive to the colouration of the sound by these break-up modes. For this reason high frequency drive units generally have a small diameter. Recently it has been demonstrated that the presence of break-up modes at frequencies that lie outside the accepted range of human hearing can cause audible degradation of the source. For this reason several attempts have been made to produce drive units that can operate at frequencies higher than 20 kHz without distortion.

The ideal loudspeaker would have very low mass, to enhance its sensitivity, and very high rigidity with no resonances within or close to the frequency spectrum of operation which could affect the audible output. All practical tweeter devices naturally have mass, and also resonances. Developments in audio media and amplification systems, such as the so called Super Audio formats (SACD and DVDA) extend the range of frequencies provided in the drive to modern speakers up to as high as 96 kHz, compared for example with the upper limit of the bandwidth of a standard CD, which is about 22 kHz.

It is well known that lighter and more rigid tweeter structures, fabricated using materials with a higher value of Young's modulus and lower density, show higher frequency resonances. As such, the use of diamond in tweeters is well reported. Prior art records a variety of configurations of speaker dome, fabricated by a range of means, but the performance advantage reported is generally poor and such speaker domes are not in widespread use. There is also substantial prior art in tweeter devices based on other materials such as Al, Be and plastics, and on a range of geometries.

U.S. Pat. No. 5,556,464 discloses the use of diamond domes for speakers, describing in detail the need to terminate the edge of the integral planar flange in a manner designed to control edge cracks developing. DE Patent 10049744 discloses the use of a diamond dome mounted concave onto a voice coil former, such that the edges of the dome are unsupported. This type of geometry provides for a range of unwanted resonances in the dome structure that may colour the output sound. More recently, Bower and Wilkins (B&W Loudspeakers Ltd, Dale Road, Worthing, West Sussex, England) have launched a range of speakers using diamond domes, the design of which is described in co-pending GB patent application 0408458.8.

However there are limitations on the use of diamond and other stiff materials in speaker domes, particularly in the larger units required for large auditoriums, for example. The resonance frequencies of such larger units cannot easily be displaced to high frequencies beyond the point at which they impact on the audible perception, and the nature of high stiffness materials and high rigidity structures is generally to have low damping or a high Q factor at resonance.

SUMMARY OF THE INVENTION

According to a first aspect of the invention, a rigid three-dimensional component formed of diamond, preferably fabricated to net shape by CVD diamond synthesis, comprises a coating on one or more major surfaces thereof, the coating being designed to enhance the performance and/or to alter the appearance of the component.

In a preferred embodiment of this aspect of the invention, the coating is designed to act as a damping medium. As such, a surface coating provides the optimum location to provide damping of transverse waves propagating on the surface of the structure, and an adequate location to provide damping of compression waves within the plane of the structure.

The damping medium preferably provides significant damping, even in thin film form, whilst providing low additional mass to the component, hereinafter referred to as low additional sheet density.

The coating may not be applied uniformly to the structure, but may for example be thicker in regions where the structure is less sensitive to the mass being added to the structure, particularly if these regions are equally, or in some instances more effective, in providing the benefit of damping obtained from the coating to the component as a whole.

In another preferred embodiment of this aspect of the invention, the coating also, or alternatively, provides aesthetic qualities to the component. For example, in high value applications where the structure is visible, it may be appropriate to use coatings to modify the colour, colour uniformity, or transparency of the component.

The component is preferably a speaker dome.

According to a second aspect of the invention, a rigid three-dimensional speaker component, in particular a speaker dome, is formed of a material of high stiffness, in particular of high specific stiffness, or of a material of high rigidity, such as a partially densified material having high rigidity, and comprises a coating on one or more major surfaces thereof, the coating being designed to enhance the performance of the component and/or to alter the appearance of the component.

Once again, the coating may be provided as a damping medium and/or to provide aesthetic qualities to the component, as described above.

In the case of a speaker dome, the coating may be placed on either the inside surface of the dome or the outside surface of the dome, or a combination thereof. Preferably a coating for aesthetic purposes is placed on the outside or visible surface of the dome, particularly where the dome is formed from diamond.

A particularly useful combination is a coating on the outside or visible surface of the dome to modify or control aesthetics, and a coating, which may be the same or a different coating, on the inside or non-visible surface of the dome to modify or provide damping characteristics.

A further particularly useful combination is a polycrystalline CVD diamond dome where the growth face of the polycrystalline diamond layer forms the external or visible surface of the dome and this surface is coated with metal. Under such circumstances the metal enhances the faceted surface of the diamond layer giving light scatter or 'brilliance'. Such an effect may be enhanced further by suitable lighting, either integral to the speaker system or forming part of the environment in which the speakers are used.

Suitable coating materials include metals such as Ti, Au, Pt and Al, for example, particularly Ti, Au and Al, and polymers, plastics and other solid organic materials including polymer based paints, resists and photo-resists, for example.

Metals are particularly useful for aesthetic purposes, with the preferred metals being Ti, Pt and Au. They can, however, also provide damping, the preferred metals being Au, Pt and Al. In aesthetic applications, the thickness of the coating can be quite thin, and not add significantly to the overall sheet density of the structure.

Polymers and plastics are particularly good at providing damping, particularly those based on long chain molecules. An important issue here is long term adhesion, but in addition consideration must be given to the sheet density added to the structure and the impact this has on the resonance behaviour, since layers of significant thickness are generally required. By careful selection of a coating material it is possible to provide both aesthetic and damping benefits from the use of a single coating material, which may be applied to one or both major surfaces.

The component of the invention preferably comprises a dome segment having an integral coil mounting flange or tube, such that the component is suitable for use as a speaker dome, with one or more coatings as described above. The dome body is typically convex from the side of the listener.

In a particularly preferred embodiment of the invention, the component is a high performance tweeter dome, and particularly a high power tweeter dome suitable for high acoustic power projection, such as required in auditoriums and the like.

DETAILED DESCRIPTION OF PREFERRED EMBODIMENTS

The invention is directed at the formation of rigid three-dimensional components having relatively low mass, and which are coated to provide additional damping or aesthetic characteristics.

The rigid three-dimensional component is formed of a material of high stiffness, and preferably of high specific stiffness, or of a partially densified material that has high rigidity, and is coated on one or more major surfaces thereof. The coating is designed to enhance the performance and/or to alter the appearance of the component.

The rigid three-dimensional component, which is preferably a speaker component, in particular a speaker dome, onto which the coating is applied may comprise one of:

a) a diamond structure, fabricated to net shape by CVD diamond synthesis;

b) a densified metal or metal alloy matrix composite embedded with ultra-hard particles or grit, preferably diamond and/or cBN particles or grit;

c) a partially densified metal or metal alloy matrix composite embedded with ultra-hard particles or grit, preferably diamond and/or cBN particles or grit; or d) a partially densified metal or metal alloy For clarity, certain of the terminology is defined below.

Stiffness is a specific technical term relating to the Elastic Modulus (Young's Modulus) of a material:

$$\text{Stiffness}=\text{Young's Modulus}=E.$$

Often a second key parameter is the density of a material, and so a further term is defined as:

$$\text{Specific Stiffness}=E/\rho,\ \text{where } \rho=\text{density}.$$

However, using material with the same stiffness it is possible to construct structures which are much less compliant than others, for example comparing I beams over flat plates. Thus:

Rigidity=structure's resistance to deformation by bending.

In a structural foam or partially densified material, or in a structure comprising dissimilar layers such as a diamond dome coated with other materials, a further key parameter is the sheet density or density per unit area of the sheet:

$$\text{Sheet density}=\rho/A,\ \text{where A=area in the plane of the sheet.}$$

In a dome or similar three-dimensional structure, the rigidity is a function of the wall or shell thickness of the dome, and also parameters such as the radius of the sphere of which the dome forms a part and the proportion of the sphere which forms the dome.

These definitions of stiffness, specific stiffness, rigidity and sheet density are assumed throughout this specification.

With reference to a three-dimensional component or body formed from diamond or densified metal or metal alloy matrix composite embedded with ultra-hard particles or grit, preferably diamond and/or cBN particles or grit, onto which coatings are applied in order to modify the damping or resonant behaviour of the structure, the coating or coatings and the body onto which they are applied will preferably fulfil one or more of the following criteria:

a) the body will be formed from a thin layer, and in particular the thickness of the layer forming the body will preferably not exceed 500 μm, and more preferably not exceed 200 μm, and even more preferably not exceed 100 μm, and even more preferably not exceed 70 μm, and most preferably not exceed 50 μm;

b) the thickness of the layer forming the body will preferably exceed 5 μm, and more preferably exceed 10 μm, and even more preferably exceed 20 μm, and even more preferably exceed 30 μm, and most preferably exceed 40 μm;

c) the coating providing modification of the damping or resonant properties may be placed on one or both major surfaces of the structure. Where the coating is placed on one surface only this is preferably the inside surface or the surface which is less visible in normal use;

d) the coating preferably increases the sheet density of the structure by less than 20%, and more preferably by less than 10%, and even more preferably by less than 5%, and even more preferably by less than 2%, and most preferably by less than 1%.

e) the coating may be fully densified, or it may be only partially densified, or it may be porous. In particular the layer may be foamed;

f) the coating may be uniform in thickness and/or in sheet density across the structure, or its thickness and/or sheet density may vary to optimise the overall damping efficiency whilst minimising the impact on the total sheet density and the break-up or other resonant frequency of the structure;

g) the coating is preferably organic. A particularly advantageous form of coating comprises long organic chains in which the degree of cross-linking can be modified, for example by UV curing, as part of the optimisation of the properties of the layer and in particular its damping efficiency at the frequencies of interest;

h) the organic layer preferably contains heavy elements such as chlorine, bromine etc. in halo-organic structures, or it may contain metal atoms.

i) the coating itself may comprise more than one layer, the first layer for example providing a good adhesion to the surface of the rigid structure, and the second layer providing the damping efficiency required.

In addition, the coating must be adherent for the expected life of the product, and retain its mechanical/damping properties without substantial change over that product life, and under the normal environmental conditions applicable to the product.

With reference to a three-dimensional component or body formed from diamond or densified metal or metal alloy matrix composite embedded with ultra-hard particles or grit, preferably diamond and/or cBN particles or grit, onto which coatings are applied in order to modify or enhance the aesthetic properties of the structure, the coating or coatings and the body onto which they are applied will preferably fulfil one or more of the following criteria:

a) the body will be formed from a thin layer, and in particular the thickness of the layer forming the body will preferably not exceed 500 μm, and more preferably not exceed 200 μm, and even more preferably not exceed 100 μm, and even more preferably not exceed 70 μm, and most preferably not exceed 50 μm;

b) the thickness of the layer forming the body will preferably exceed 5 μm, and more preferably exceed 10 μm, and even more preferably exceed 20 μm, and even more preferably exceed 30 μm, and most preferably exceed 40 μm;

c) the coating providing modification or enhancement of the aesthetic properties of the structure may be placed on one or both major surfaces of the structure. Where the coating is placed on one surface only this is preferably the outside surface or the surface which is more visible in normal use. Except in applications where both surfaces are visible, the coating would preferably be applied to one surface only;

d) the coating preferably increases the sheet density of the structure by less than 3%, and more preferably by less than 1%, and even more preferably by less than 0.5%, and even more preferably by less than 0.2%, and most preferably by less than 0.1%;

e) the coating is preferably fully dense, or as fully dense as the method of application practically allows;

f) the coating may vary in thickness across the structure, but in general is uniform in thickness, at least to the degree allowed by the methods of applying the coating, in those regions where it is present. The coating may be deliberately patterned to provide additional visual impact or another visible characteristic, said patterning comprising windows in the coating or combination of regions of different metals or other materials in order to form a visible pattern;

g) the coating is preferably metal or metal alloy;

h) the coating itself may comprise more than one layer, the first layer for example providing a good adhesion to the diamond surface, for which Ti is particularly applicable, and the second layer providing the optical opacity and other characteristics such as colour required.

Where desired, the aesthetic coating may provide for the marking of the rigid structure with a trademark or other character or symbol. This symbol can be provided as a variation in colour between regions, for example using a Pt or Ti background and Au characters, or by leaving transparent apertures in the coating. The latter is particularly applicable with diamond structures, for example diamond speaker domes, since the dome can then have a backlight and the character made visible as an illuminated region of the dome. Under such circumstances a second coloured but transparent coating may provide colour to the backlit character.

In particular the invention relates to the use of such components in the application of loudspeaker drive units.

The component fabricated by any of the above means may be a dome segment, which may have an integral coil mounting flange or tube so that it is suitable for use as a speaker dome. In particular, the component is a high performance tweeter dome. Preferably, the tweeter dome demonstrates one or more of the following properties in combination, when tested in an ideal mount essentially free of effects from the surround:

a) a break-up frequency (BUF), for a speaker dome of radius of curvature 20 mm and segment diameter of 26 mm, scaled appropriately for other sizes, that is greater than 31 kHz, preferably greater than 45 kHz, more preferably greater than 55 kHz, even more preferably greater than 65 kHz, and most preferably greater than 75 kHz;

b) a deviation in the on axis response curve from the modelled ideal on axis response curve, allowing for phase roll-off, measured at 3/9 BUF, preferably at 4/9 BUF, more preferably at 5/9 BUF, and more preferably at 6/9 BUF, and most preferably 7/9 BUF, which is less than 5 dB, preferably less than 3 dB, more preferably less than 2 dB, even more preferably less than 1 dB, and most preferably less than 0.5 dB; and c) a deviation in the on axis response curve from a flat response measured at 3/9 BUF, preferably at 4/9 BUF, more preferably at 5/9 BUF, and more preferably at 6/9 BUF, and most preferably 7/9 BUF, which is less than 5 dB, preferably less than 3 dB, more preferably less than 2 dB, even more preferably less than 1 dB, and most preferably less than 0.5 dB.

A tweeter to the above specification can be used to provide output to modern audio sources with higher audio quality and improved aesthetics over alternative solutions.

In a preferred version of this embodiment of the invention, the high performance tweeter dome is fabricated to one or more of the following criteria:

a) the tweeter is based on a dome which is convex when viewed from the side of the listener;

b) the tweeter dome is axially symmetric and based on a parabola in which the two axes a, b (where a>=b) are such that a/b is less than 1.5, preferably less than 1.2, more preferably less than 1.1, even more preferably less than 1.05, and most preferably less than 1.01;

c) the tweeter dome is fabricated with an integral axial tube component that either directly provides the former for the voice coils or alternatively provides the means of mechanical attachment for a separate voice coil former, made for example from Al or Kapton;

d) the diameter of the domed area of the tweeter exceeds 24 mm, preferably exceeds 35 mm, more preferably exceeds 45 mm, even more preferably exceeds 55 mm, and most preferably exceeds 65 mm, and the radius of curvature of the tweeter dome exceeds 18 mm, preferably exceeds 26 mm, more preferably exceeds 33 mm, even more preferably exceeds 40 mm, and most preferably exceeds 47 mm.

The speaker dome of this invention has a number of benefits. Whereas diamond, the material with the highest known specific stiffness, can be used to fabricate speaker domes less than 30 mm in diameter where the first break-up frequency is at or at least near 70 kHz, removing any significant effect on the audible frequencies up to 20 kHz, larger diameter tweeters which are generally required for higher power output as may be used in auditoriums etc, also require a larger radius of curvature, and both these characteristics reduces the break-up frequency of the dome. The low damping behaviour of diamond then becomes a disadvantage. However, by combining a very high specific stiffness material such as diamond, or a very rigid structural design such as a partially densified diamond metal matrix composite, with a surface coating which provides suitable damping without substantially affecting the sheet density and thus the break-up frequency, the overall acoustic performance of the speaker can be improved.

Viewing the composite structure, in order to obtain the most efficient use of the high damping efficiency layer, locating the damping layer at an external surface is the ideal location to damp out transverse waves, since the deformation is maximised at this point. Transverse waves are the main source of acoustic interference, and or the main type of wave excited by the oscillation of the dome perpendicular to its span. Compression waves in the plane of the dome are equally damped by positioning the damping layer anywhere through the thickness of the composite structure, and so location at the surface is satisfactory, although compression waves are not considered to be a major cause of acoustic interference.

Coatings with high damping efficiency can be applied by a number of techniques, including:

a) application as an organic in a solvent medium, by spinning, spraying or coating, using similar techniques to paints or resists;

b) application as a multi-component system which sets by chemical reaction, in much the same way as an epoxy resin;

c) application as a single component system which is cured or set by thermal, optical or other means, such means including oxidation in contact with air, baking, UV curing etc.

In each case above, the coating may then be modified further by baking, UV curing etc. in order to obtain the precise damping efficiency required.

Coatings for aesthetic applications can also be applied by a number of techniques, including: sputtering coating, evaporation techniques, CVD coating techniques, plasma spraying, and thermal spraying. In addition, a range of organic chemistry based techniques such as sol-gel processing can be used.

The invention claimed is:

1. A speaker dome, comprising:

a dome body formed of a material of high stiffness or high rigidity and having respective inner and outer surfaces; and a coating on either one or both of the surfaces of the dome body, wherein the coating is formed of material selected from a group consisting of metals, polymers, plastics, and other solid organic coating materials, wherein the dome body is formed of diamond, and wherein the diamond dome body is fabricated to a net shape by CVD diamond synthesis.

2. A speaker dome according to claim 1, wherein the coating comprises a metal selected from Ti, Au, Pt, and Al.

3. A speaker dome according to claim 1, wherein the coating comprises a metal selected from Ti, Au, and Al.

4. A speaker dome according to claim 1, wherein the coating comprises a polymer based paint, a resist material or a photo-resist material.

5. A speaker dome according to claim 1, wherein the dome body has a thickness of from 5 μm to 500 μm.

6. A speaker dome according to claim 1, wherein the dome body has a thickness of from 20 μm to 100 μm.

7. A speaker dome according to claim 1, wherein the dome body has a thickness of from 40 μm to 50 μm.

8. A speaker dome according to claim 1, wherein the dome body is convex from the side of the listener.

9. A speaker dome according to claim 1, further comprising:

an integral coil mounting flange or tube.

10. A speaker dome according to claim 1, wherein the coating includes a plurality of separate layers of different materials.

11. A speaker dome according to claim 1, wherein the coating is arranged to modify the damping or resonant behaviour of the speaker dome.

12. A speaker dome according to claim 11, wherein the coating damps out deleterious vibrations, or reduces their amplitude or impact on audible performance of the speaker dome.

13. A speaker dome according to claim 11, wherein a break-up frequency thereof is greater than 45 kHz and a deviation in an on-axis response curve from a flat response, measured at 4/9 of the break-up frequency, is less than 3 dB.

14. A speaker dome according to any one of claims 11 to 13, wherein the coating is placed on the inner surface of the dome body.

15. A speaker dome according to claim 11, wherein the coating increases a sheet density of the dome body by less than 20%.

16. A speaker dome according to claim 15, wherein the coating increases the sheet density of the dome body by less than 5%.

17. A speaker dome according to claim 16, wherein the coating increases the sheet density of the dome body by less than 1%.

18. A speaker dome according to claim 11, wherein the coating is partially densified or porous.

19. A speaker dome according to claim 18, wherein the coating is foamed.

20. A speaker dome according to claim 11, wherein the coating is formed of an organic material.

21. A speaker dome according to claim 1, wherein the coating is arranged to modify or enhance aesthetic properties or an appearance of the speaker dome.

22. A speaker dome according to claim 21, wherein the coating is placed on the outer surface of the dome body.

23. A speaker dome according to claim 21 or claim 22, wherein the coating increases a sheet density of the dome body by less than 3%.

24. A speaker dome according to claim 23, wherein the coating increases the sheet density of the dome body by less than 0.5%.

25. A speaker dome according to claim 24, wherein the coating increases the sheet density of the dome body by less than 0.1%.

26. A speaker dome according to claim 21, wherein the coating is formed of a metal or metal alloy.

27. A speaker dome according to claim 1, wherein the coating is patterned to provide a trademark or other character or symbol.

28. A speaker dome according to claim 27, wherein the patterning includes open or transparent apertures in the coating suitable for back lighting.

29. A speaker dome according to claim 1, wherein the speaker dome is a high performance tweeter dome.

30. A speaker dome according to claim 29, wherein the speaker dome is a high power tweeter dome suitable for high acoustic power projection.

31. A speaker dome according to claim 29 or claim 30, wherein a diameter of the dome body of the tweeter is greater than 24 mm.

32. A speaker dome according to claim 31, wherein the diameter of the dome body of the tweeter dome is greater than 35 mm.

* * * * *